US008760064B1

(12) United States Patent
Yoon et al.

(10) Patent No.: US 8,760,064 B1
(45) Date of Patent: Jun. 24, 2014

(54) LED LIGHTING APPARATUS WITH IMPROVED TOTAL HARMONIC DISTORTION IN SOURCE CURRENT

(71) Applicant: Posco LED Company Ltd., Seongnam-si (KR)

(72) Inventors: Seong Bok Yoon, Seongnam-si (KR); Dae Won Kim, Seongnam-si (KR); Jung Hwa Kim, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 31 days.

(21) Appl. No.: 13/731,816

(22) Filed: Dec. 31, 2012

(30) Foreign Application Priority Data

Dec. 21, 2012 (KR) ..... 10-2012-0150881

(51) Int. Cl.
*H05B 37/00* (2006.01)
*H05B 39/00* (2006.01)
*H05B 41/00* (2006.01)

(52) U.S. Cl.
USPC ..... 315/192; 315/185 R; 315/186; 315/187

(58) Field of Classification Search
None
See application file for complete search history.

(56) References Cited

U.S. PATENT DOCUMENTS

| | | | | |
|---|---|---|---|---|
| 2009/0026972 | A1 | 1/2009 | Shakuda | |
| 2011/0227490 | A1* | 9/2011 | Huynh | 315/185 R |
| 2012/0049754 | A1 | 3/2012 | Suzuki | |
| 2012/0299489 | A1* | 11/2012 | Sakuragi et al. | 315/187 |

FOREIGN PATENT DOCUMENTS

| | | |
|---|---|---|
| JP | 59-198873 | 11/1984 |
| JP | 10-174443 | 6/1998 |
| JP | 2002-345250 | 11/2002 |
| JP | 2007-189004 | 7/2007 |
| JP | 2008-187886 | 8/2008 |
| JP | 2009-283775 | 12/2009 |
| JP | 2012-243745 | 12/2012 |
| KR | 10-1040135 | 6/2011 |
| KR | 10-1110380 | 2/2012 |
| KR | 10-2012-0019384 | 3/2012 |
| KR | 10-2012-0069512 | 6/2012 |
| WO | 2007/072873 | 6/2007 |

(Continued)

OTHER PUBLICATIONS

International Search Report submitted with International Application No. PCT/KR2012/011849 dated Sep. 6, 2013.

(Continued)

*Primary Examiner* — Anh Tran
(74) *Attorney, Agent, or Firm* — H.C. Park & Associates, PLC

(57) ABSTRACT

The LED lighting apparatus includes: a rectification block; an LED block including a first light emitting group and a second light emitting group; a charging/discharging block configured to charge electric charges in a charging period, and discharge electric charges in a discharging period; a driving control unit configured to determine a voltage level of a rectified voltage, controls a path selection switch to connect the rectification block to the LED block and controls the charging/discharging block to charge electric charges in the charging period, and controls the path selection switch to connect the rectification block to a ground and controls the charging/discharging block to discharge electric charges from the charging/discharging block to the LED block in the discharging period; and a path selection switch configured to connect the rectification block to the LED block in the charging period, and connect the rectification block to the ground in the discharging period.

17 Claims, 4 Drawing Sheets

(56) References Cited

FOREIGN PATENT DOCUMENTS

| | | |
|---|---|---|
| WO | 2008/139922 | 11/2008 |
| WO | 2010-076925 | 7/2010 |
| WO | 2012-081878 | 6/2012 |
| WO | 2012-086956 | 6/2012 |

OTHER PUBLICATIONS

Written Opinion submitted with International Application No. PCT/KR2012/011849 dated Sep. 6, 2013.

* cited by examiner

LED LIGHTING APPARATUS WITH IMPROVED TOTAL HARMONIC DISTORTION IN SOURCE CURRENT

CROSS-REFERENCE TO RELATED APPLICATION

This application claims priority of Korean Patent Application No. 10-2012-0150881, filed on Dec. 21, 2012, in the Korean Intellectual Property Office, which is hereby incorporated by reference in its entirety.

BACKGROUND OF THE INVENTION

1. Field of the Invention

The present invention relates to an LED lighting apparatus with improved harmonic distortion components of a source current, and more particularly, to an LED lighting apparatus, which increases a power factor by improving a total harmonic distortion (THD) of an input current in such a manner that a waveform of the input current output from a rectification block is made maximally close to a sine wave by using a path selection switch and a charging/discharging block, and improves the lifespan and luminous intensity uniformity of LED elements by actively changing a series/parallel connection relationship among a plurality of LED groups according to a voltage level of a rectified voltage.

2. Description of the Related Art

A light emitting diode (LED) is a semiconductor element that is made of a material such as Ga, P, As, In, N, and Al. The LED has a diode characteristic and emits red light, green light, or yellow light when a current flows therethrough. Compared with a bulb or lamp, the LED has a long lifespan, a fast response speed (time until light is emitted after a current flows), and low power consumption. Due to these advantages, the LED has tended to be widely used.

In general, a light emitting element could be driven only at a DC voltage due to the diode characteristic. Therefore, a light emitting device using the light emitting element is restrictive in use and must include a separate circuit, such as SMPS, so as to use an AC voltage that has been used at home. Consequently, the circuit of the light emitting device becomes complicated and the manufacturing cost of the light emitting device increases.

In order to solve these problems, much research has been conducted on a light emitting element that can also be driven at an AC voltage by connecting a plurality of light emitting cells in series or in parallel.

FIG. 1A is a block diagram illustrating a configuration of a conventional LED lighting apparatus, and FIG. 1B is a waveform diagram illustrating waveforms of a rectified voltage and a rectified current in the conventional LED lighting apparatus of FIG. 1A.

As illustrated in FIG. 1A, the conventional LED lighting apparatus includes an AC power source $V_{AC}$, a rectification block 10, and an LED block (LED array) 20. The rectification block 10 receives an AC voltage from the AC power source $V_{AC}$ and performs a full-wave rectification to output a rectified voltage $V_{rec}$. The LED block 20 includes one or more LEDs that receive the rectified voltage $V_{rec}$ from the rectification block 10 and emit light. In general, even when the rectified voltage $V_{rec}$ is applied from the rectification block 10, no current flows from the rectification block 10 to the LED block 20 due to the component characteristic of the LED until before a threshold voltage level $V_{TH}$ capable of driving the LED block 20 is applied. Consequently, in a period during which the voltage level of the rectified voltage $V_{rec}$ is lower than the threshold voltage level $V_{TH}$, a current $I_{rec}$ does not flow through the LED block 20. Hence, as illustrated in FIG. 1B, the current $I_{rec}$ output from the rectification block 10 does not have a sine waveform, and a total harmonic distortion (THD) characteristic is bad. In addition, in the case of the conventional LED lighting apparatus, the LED block 20 emits light only in a period during which the voltage level of the rectified voltage $V_{rec}$ is equal to or higher than the threshold voltage level $V_{TH}$. Therefore, a power factor is deteriorated. In order to solve these problems, a power factor correction (PFC) circuit may be added to the LED lighting apparatus of FIG. 1A. However, in this case, the size of the LED lighting apparatus increases, and the manufacturing cost of the LED lighting apparatus rises. Also, the circuit configuration of the LED lighting apparatus becomes complicated.

Furthermore, although not illustrated, the conventional LED lighting apparatus may include a plurality of LED arrays and may be configured to perform a so-called sequential driving scheme that sequentially turns on/off the plurality of LED arrays according to the voltage level of the rectified voltage. However, in the case of the LED lighting apparatus using the conventional sequential driving scheme, since the light emission periods of the plurality of LED arrays are different, the luminous intensity uniformity of the LED lighting apparatus is degraded and the lifespan of the LED arrays becomes disproportionate. Therefore, the lifespan of the LED lighting apparatus is subjected to the LED array having a relatively long emission time.

SUMMARY OF THE INVENTION

The present invention has been made in an effort to solve the above-described problems of the related art.

The present invention is directed to provide an LED lighting apparatus, which can increase a power factor by improving a total harmonic distortion (THD) of an input current in such a manner that a waveform of the input current output from a rectification block is made maximally close to a sine wave by using a path selection switch and a charging/discharging block.

The present invention is also directed to provide an LED lighting apparatus, which can improve luminous intensity uniformity and brightness by causing all light emitting groups to emit light at above a predetermined voltage level in such a manner that a series/parallel connection relationship among a plurality of light emitting groups are actively controlled according to a voltage level of a rectified voltage.

The characteristic configurations of the present invention for achieving the above objects of the present invention and achieving unique effects of the present invention are as follows.

According to an embodiment of the present invention, an LED lighting apparatus includes: a rectification block configured to rectify an AC voltage to a DC rectified voltage; an LED block including a first light emitting group and a second light emitting group each including one or more LEDs; a charging/discharging block configured to charge electric charges in a charging period, and discharge electric charges in a discharging period such that the LED block emits light; a driving control unit configured to determine a voltage level of the rectified voltage output from the rectification block, controls a path selection switch to connect the rectification block to the LED block and controls the charging/discharging block to charge the charging/discharging block with electric charges, when the voltage level of the rectified voltage enters the charging period, and controls the path selection switch to connect the rectification block to a ground and controls the charging/discharging block to discharge electric charges from the charging/discharging block to the LED block, when the voltage level of the rectified voltage enters the discharging period; and a path selection switch configured to connect the rectification block to the LED block in the charging period, and connect the rectification block to the ground in the discharging period.

The LED block may further include a first switch, a second switch, and a third switch configured to modify a circuit such that the first light emitting group and the second light emitting group are connected in series or in parallel according to the voltage level of the rectified voltage, and the driving control unit may control the first switch, the second switch, and the third switch according to the voltage level of the rectified voltage, such that a connection relationship of the first light emitting group and the second light emitting group is controlled in series or in parallel.

When the input rectified voltage is equal to or higher than a first threshold voltage level and lower than a second threshold voltage level, the driving control unit may turn on the first switch and the second switch and turns off the third switch, such that the first light emitting group and the second light emitting group are connected in parallel.

When the input rectified voltage is equal to or higher than the second threshold voltage level, the driving control unit may turn off the first switch and the second switch and turn on the third switch, such that the first light emitting group and the second light emitting group are connected in series.

Even in a period during which the voltage level of the rectified voltage is lower than the first threshold voltage level, the first light emitting group and the second light emitting group may not be turned off and may be driven by electric charges discharged from the charging/discharging block.

The charging/discharging block may include a capacitor and a charging/discharging control switch, and the driving control unit may control the charging/discharging control switch, such that electric charges are charged to the capacitor during the charging period, and electric charges charged in the capacitor may be supplied to the LED block during the discharging period.

The path selection switch may be controlled by a path selection switch control signal (SSW_CNT) output from the driving control unit.

The control of the first switch, the second switch, and the third switch included in the LED block may be adjusted by switch control signals (SW_CNT1 to SW_CNT3) output from the driving control unit.

The charging/discharging control switch may be controlled by a charging/discharging switch control signal (SW_CNT4) output from the driving control unit.

The switches may include at least one of a metal-oxide semiconductor field effect transistor (MOSFET), an insulated gate bipolar transistor (IGBT), a bipolar junction transistor (BJT), a junction field effect transistor (JFET), a thyristor (silicon controlled rectifier), and a triac.

According to another embodiment of the present invention, an LED lighting apparatus includes: a rectification block configured to rectify an AC voltage to a DC rectified voltage; an LED block including a first light emitting group and a second light emitting group each including one or more LEDs; a charging/discharging block configured to charge electric charges in a charging period, and discharge electric charges in a discharging period, such that the LED block emits light; and a driving control unit configured to supply the rectified voltage to the LED block when a voltage level of the rectified voltage enters the charging period, such that electric charges are charged to the charging/discharging block, and connect the rectified voltage to a ground when the voltage level of the rectified voltage enters the discharging period, such that electric charges charged in the charging/discharging block are discharged to the LED block.

The LED lighting apparatus may further include a path selection switch configured to connect the rectification block to the LED block during the charging period, and connect the rectification block to the ground during the discharging period.

Even in a period during which the voltage level of the rectified voltage is lower than the first threshold voltage level, the first light emitting group and the second light emitting group may not be turned off and may be driven by electric charges discharged from the charging/discharging block.

The charging/discharging block may include a capacitor and a charging/discharging control switch, and the driving control unit may control the charging/discharging control switch, such that electric charges are charged to the capacitor during the charging period, and electric charges charged in the capacitor may be supplied to the LED block during the discharging period.

The charging/discharging control switch may be controlled by a charging/discharging switch control signal (SW_CNT4) output from the driving control unit.

DETAILED DESCRIPTION OF EXEMPLARY EMBODIMENTS

Figure 1A:
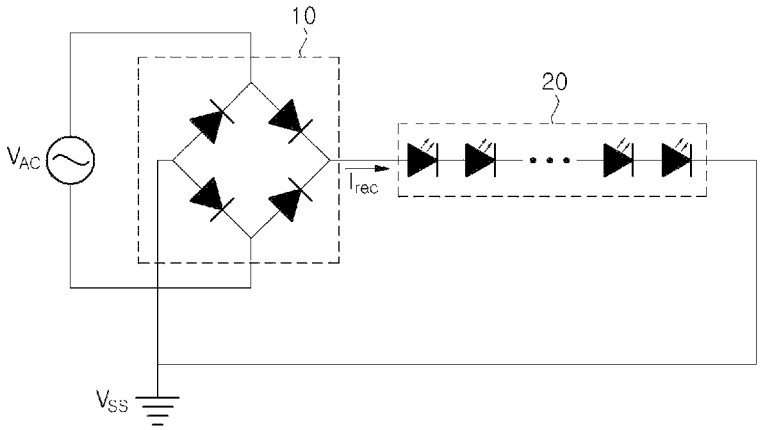
FIG. 1A is a block diagram illustrating a configuration of a conventional LED lighting apparatus.
Figure 1B:
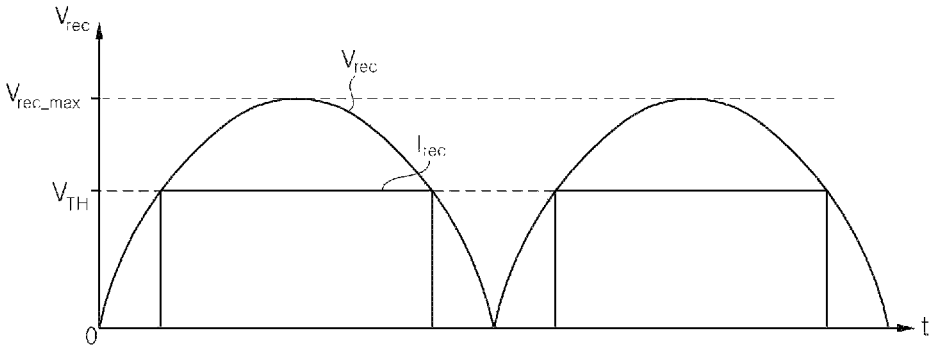
FIG. 1B is a waveform diagram illustrating waveforms of a rectified voltage and a rectified current in the conventional LED lighting apparatus of FIG. 1A.

Specific embodiments of the present invention will be described below in detail with reference to the accompanying drawings. These embodiments will be fully described in such a manner that those skilled in the art can easily carry out the present invention. It should be understood that various embodiments of the present invention are different from one another, but need not be mutually exclusive. For example, specific shapes, structures and characteristics described herein can be implemented in other embodiments, without departing from the spirit and scope of the present invention. In addition, it should be understood that the positions and arrangements of the individual elements within the disclosed embodiments can be modified without departing from the spirit and scope of the present invention. Therefore, the following detailed description is not intended to be restrictive. If appropriately described, the scope of the present invention is limited only by the accompanying claims and the equivalents thereof. Throughout the drawings, similar reference numerals refer to same or similar functions in various aspects.

Hereinafter, preferred embodiments of the present invention will be described in detail with reference to the accompanying drawings, such that those skilled in the art can easily carry out the present invention.

Preferred Embodiment of Present Invention

In the embodiments of the present invention, the term "light emitting group" refers to a group of LEDs (LED packages) connected in series, in parallel, or in series/parallel to emit light within a lighting apparatus, and refers to a group of LEDs whose operations are controlled (that is, turned on/off at the same time) as one unit under the control of a control unit.

Also, the term "threshold voltage level $V_{TH}$" refers to a voltage level that can drive a single light emitting group. The term "first threshold voltage level $V_{TH_1}$" is a voltage level that can drive a first light emitting group, and the term "second threshold voltage level $V_{TH_2}$" is a voltage level that can drive a first light emitting group and a second light emitting group. When the threshold voltage level of the first light emitting group and the threshold voltage level of the second light emitting group are equal to each other, the second threshold voltage level $V_{TH_2}$ is $2V_{TH_1}$. Therefore, in the following, the term "n-th threshold voltage level $V_{TH_n}$" refers to a voltage level that can drive all of the first to n-th light emitting groups.

Also, the term "charging period" refers to a voltage level period during which a voltage level of a rectified voltage $V_{rec}$ is equal to or higher than the first threshold voltage level $V_{TH_1}$ so that at least the first light emitting group can be driven and electric charges can be charged to a charging/discharging block. In addition, the term "discharging period" refers to a voltage level period during which the voltage level of the rectified voltage $V_{rec}$ is lower than the first threshold voltage level $V_{TH_1}$ so that no light emitting groups can be driven and the light emitting groups are driven by electric charges discharged from the charging/discharging block.

Figure 2:
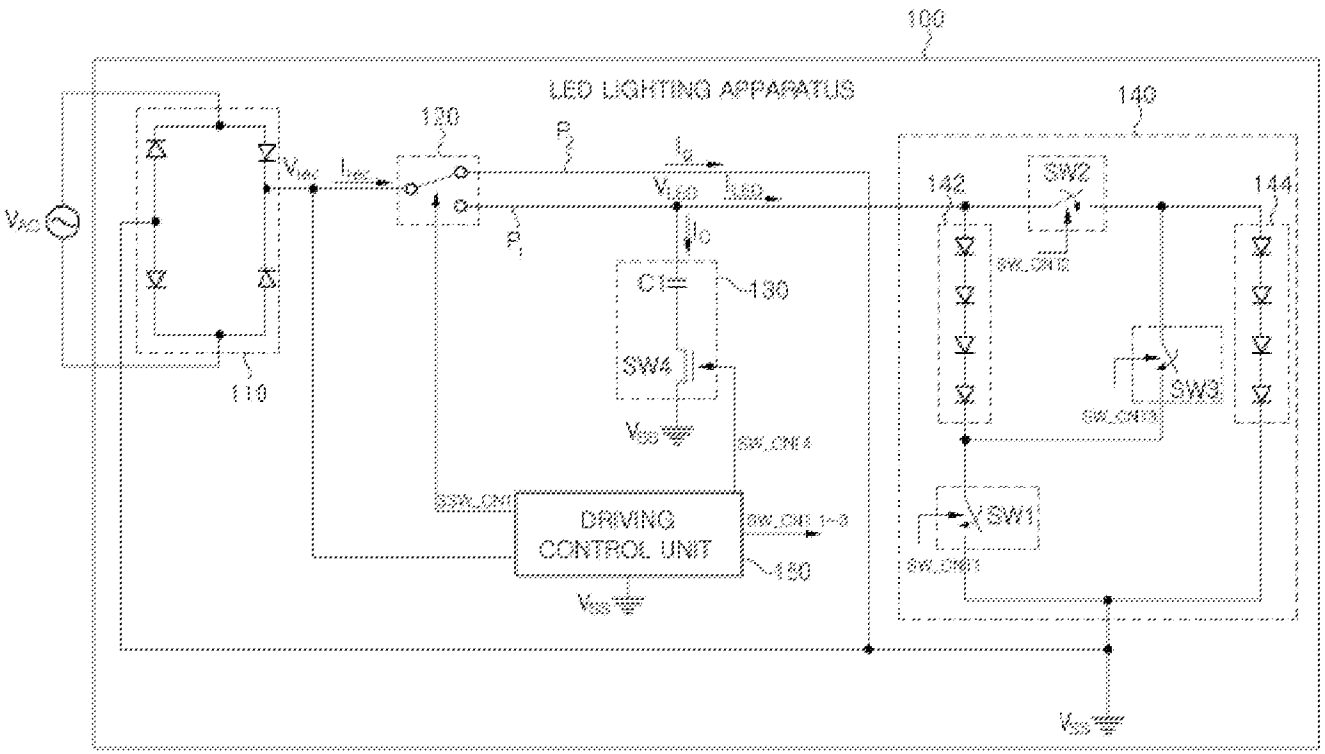
FIG. 2 is a block diagram illustrating a configuration of an LED lighting apparatus according to a preferred embodiment of the present invention.

FIG. 2 is a block diagram illustrating a configuration of an LED lighting apparatus according to a preferred embodiment of the present invention. The configuration and function of the LED lighting apparatus according to the preferred embodiment of the present invention will be described below in detail with reference to FIG. 2.

As illustrated in FIG. 2, the LED lighting apparatus 100 according to the present invention may include a rectification block 110, a path selection switch 120, a charging/discharging block 130, an LED block 140, and a driving control unit 150.

The rectification block 110 may be configured to receive an AC voltage $V_{AC}$ from an AC voltage source disposed inside or outside the LED lighting apparatus 100, rectify the received AC voltage $V_{AC}$, and output a rectified voltage $V_{rec}$. As described above, the LED lighting apparatus cannot be provided with a constant current/constant voltage circuit, such as SMPS, due to its characteristic. Therefore, the rectification block 110 according to the present invention can be implemented with a half-wave rectification circuit or a full-wave rectification circuit constituted by a full-bridge. In addition, although not illustrated, the rectification block 110 according to the present invention may further include a surge protection block (not illustrated) and a fuse (not illustrated). The surge protection block may be implemented with a varistor or the like that can protect a circuit from a surge voltage, and the fuse may be implemented with a fuse or the like that can protect a circuit from overcurrent.

Figure 5:
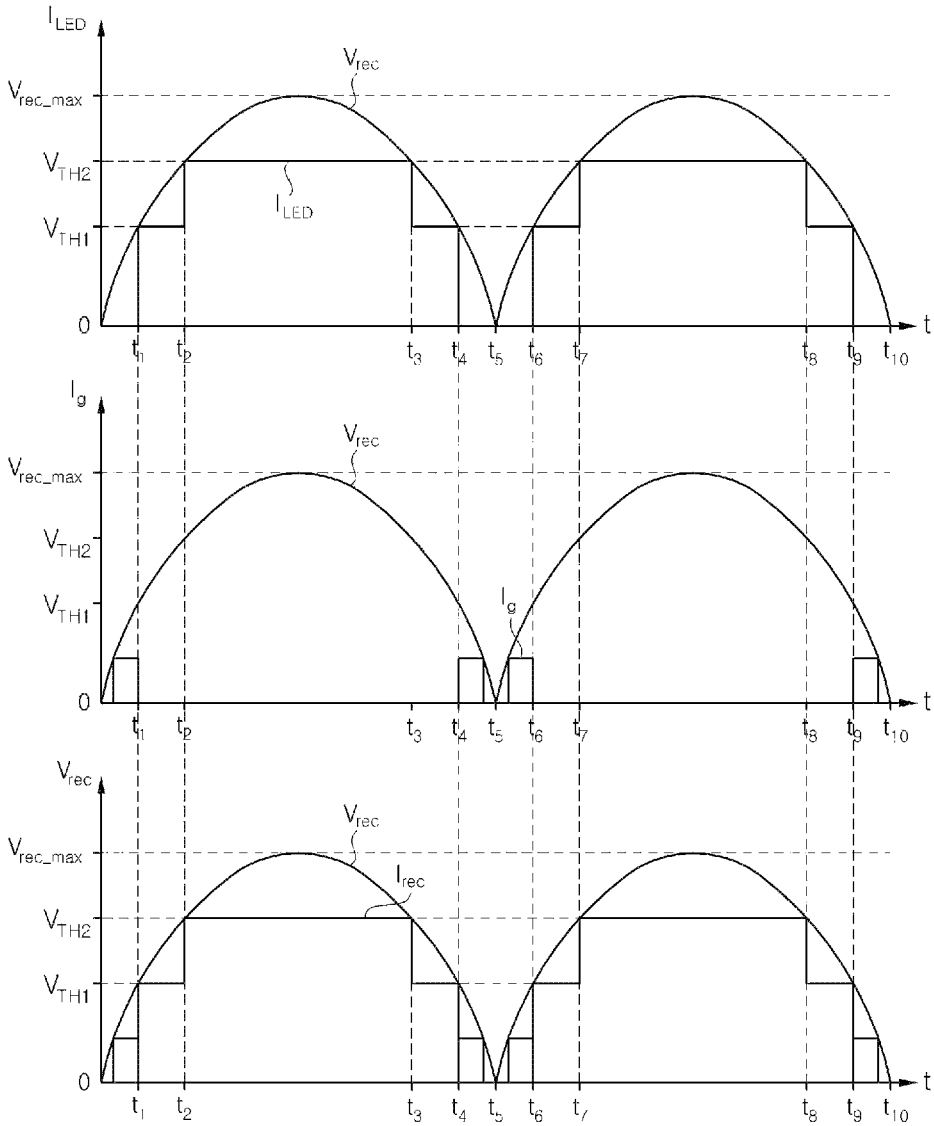
FIG. 5 is a waveform diagram illustrating waveforms of a rectified current output from a rectification block, a ground current, and an LED driving current according to a preferred embodiment of the present invention.

The path selection switch 120 is disposed between the rectification block 110 and the LED block 140 and is configured to connect the rectified voltage $V_{rec}$ output from the rectification block 110 to the LED block 140 or a ground voltage (ground) $V_{ss}$ under the control of the driving control unit 150. That is, as described above, in order to improve harmonic characteristic of a current $I_{rec}$ output from the rectification block 110, the path selection switch 120 according to the present invention connects the rectification block 110 to the ground $V_{ss}$ through a second path $P_2$ in a period during which the voltage level of the rectified voltage $V_{rec}$ is lower than a first threshold voltage level $V_{TH_1}$, so that the current $I_{rec}$ output from the rectification block 110 flows. The path selection switch 120 connects the rectification block 110 to the LED block 140 through a first path $P_1$ in a period during which the voltage level of the rectified voltage $V_{rec}$ is equal to or higher than the threshold voltage level $V_{TH_1}$, so that the rectified voltage $V_{rec}$ output from the rectification block 110 is applied to the LED block 140. The control of the path selection switch 120 is performed by a path selection switch control signal SSW_CNT output from the driving control unit 150. For this purpose, the driving control unit 150 according to the present invention determines the voltage level of the rectified voltage $V_{rec}$, generates the path selection switch control signal SSW_CNT to connect the rectification block 110 to the second path $P_2$ or the first path $P_1$ according to the determined voltage level of the rectified voltage $V_{rec}$, and outputs the path selection switch control signal SSW_CNT to the path selection switch 120. FIG. 5 is a waveform diagram illustrating waveforms of the rectified current output from the rectification block, the ground current, and the LED driving current according to a preferred embodiment of the present invention. In FIG. 5, an upper portion illustrates a waveform of the LED driving current $I_{LED}$ flowing through the first path $P_1$, a middle portion illustrates a waveform of the ground current $I_g$ flowing through the second path $P_2$, and a lower portion illustrates waveforms of the rectified voltage $V_{rec}$ and the rectified current $I_{rec}$ output from the rectification block 110. As illustrated in FIG. 5, the ground current $I_g$ flows through the second path $P_2$ during non light emission periods 0 to $t_1$, $t_4$ to $t_6$, and $t_9$ to $t_{10}$ of the LED block 140, and the driving current $I_{LED}$ flows through the first path $P_1$ during light emission periods $t_1$ to $t_4$ and $t_6$ to $t_9$ of the LED block 140. Consequently, as illustrated in the lower portion of FIG. 5, the waveform of the rectified current $I_{rec}$ output from the rectification block 110 forms a step waveform that is maximally similar to the waveform of the rectified voltage $V_{rec}$, thereby obtaining improvement in harmonic characteristic.

Meanwhile, the charging/discharging block 130 according to the present invention charges electric charges during the light emission period of the LED block 140, and drives the LED block 140 by supplying the charged electric charges to the LED block 140 during the non light emission period of the LED block 140. In order to perform such a function, the charging/discharging block 130 according to the present invention may include a charging/discharging capacitor C1 and a charging/discharging control switch SW4.

The charging/discharging control switch SW4 is configured to control the charging and discharging of the charging/discharging block 130 by controlling a charging current $I_c$ and a discharging current $I_{dis}$ under the control of the driving control unit 150. That is, when it is determined as entering the charging period, the driving control unit 150 outputs a charging/discharging switch control signal SW_CNT4 to the charging/discharging control switch SW4, and the charging/discharging control switch SW4 causes the charging current $I_c$ to flow. In addition, when it is determined as entering the discharging period, the driving control unit 150 outputs the charging/discharging switch control signal SW_CNT4 to the charging/discharging control switch SW4, and the charging/discharging control switch SW4 causes the discharging current $I_{dis}$ to flow. The charging/discharging control switch SW4 may be implemented with an electronic switching element that can control current values of the charging current $I_c$ and the discharging current $I_{dis}$. More preferably, the charging/discharging control switch SW4 may be configured to control the charging current $I_c$ with a relatively small value so as not to affect the driving of the LED block 140 in the charging period, and to control the discharging current $I_{dis}$ with a relatively large value so as to smoothly drive the LED block 140 in the discharging period.

Referring again to FIG. 5, since the rectified current $I_{rec}$ flows through the first path $P_1$ during the charging period (that is, the light emission periods $t_1$ to $t_4$ and $t_6$ to $t_9$ of the LED block 140), the charging/discharging block 130 charges electric charges. That is, most of the rectified current $I_{rec}$ output from the rectification block 110 is used as the LED driving current $I_{LED}$ for driving the LED block 140, but some of the rectified current $I_{rec}$ is used as the charging current $I_c$ of the charging/discharging capacitor C until the charging/discharging capacitor C1 is completely charged.

Meanwhile, the charging/discharging capacitor C1 is designed to have a capacitance enough to drive the LED block 140 in the discharging periods (that is, the non light emission periods 0 to $t_1$, $t_4$ to $t_6$, and $t_9$ to $t_{10}$ of the LED block 140). Therefore, as described above, in the discharging periods, the rectified current $I_{rec}$ output from the rectification block 110 flows along the second path $P_2$, and electric charges are discharged from the charging/discharging capacitor C1 to the LED block 140. In this way, the LED block 140 emits light. Therefore, it can be expected that the LED lighting apparatus 100 according to the present invention can always emit light without non light emission periods.

Figure 4:
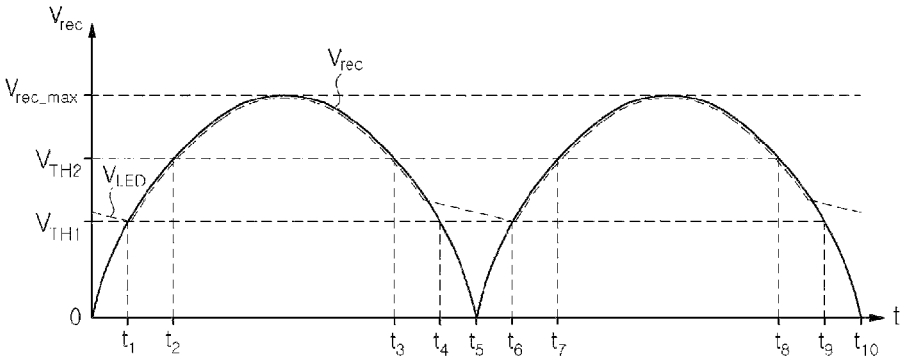
FIG. 4 is a waveform diagram illustrating waveforms of a rectified voltage and an LED driving voltage according to a preferred embodiment of the present invention.

FIG. 4 is a waveform diagram illustrating waveforms of the rectified voltage and the LED driving voltage according to the preferred embodiment of the present invention. As illustrated in FIG. 4, in the non light emission periods 0 to $t_1$, $t_4$ to $t_6$, and $t_9$ to $t_{10}$ during which the voltage level of the rectified voltage $V_{rec}$ is lower than the first threshold voltage level $V_{TH_1}$, electric charges are discharged from the charging/discharging capacitor C1, and the LED driving voltage $V_{LED}$ corresponding to the first threshold voltage level $V_{TH_1}$ is applied to the LED block 140. Therefore, the non light emission periods during which the LED block 140 according to the present invention does not emit light are eliminated.

The LED block 140 according to the present invention receives the rectified voltage $V_{rec}$ applied from the rectification block 110 and the discharging voltage applied from the charging/discharging block 130. Various types of the LED block 140 may be used for the LED lighting apparatus 100 according to the present invention. For example, the LED lighting apparatus 140 can use an LED block that can perform switching to connect a plurality of LED groups in series or in parallel according to the voltage level of the rectified voltage $V_{rec}$ under the control of the driving control unit 150. In order to perform the series/parallel switching function, the LED block 140 according to the present invention may include a first light emitting group 142 with at least one LED, a second light emitting group 144 with at least one LED, and first to third switches SW1, SW2 and SW3 configured to switch the connection between the first light emitting group 142 and the second light emitting group 144 in series or in parallel under the control of the driving control unit 150. Hereinafter, for convenience of description and understanding, the following description will focus on the first light emitting group 142 and the second light emitting group 144 each including a plurality of LEDs connected in series and having the same threshold voltage level, but the present invention is not limited thereto. It is apparent that various configurations of the LED block 140 fall within the scope of the present invention.

As illustrated in FIG. 2, the first switch SW1 is connected between a cathode of the first light emitting group 142 and the ground $V_{ss}$, the second switch SW2 is connected between an anode of the first light emitting group 142 and an anode of the second light emitting group 144, and the third switch SW3 is connected between the cathode of the first light emitting group 142 and the anode of the second light emitting group 144. The first to third switches SW1, SW2 and SW3 are turned on or off according to a switch control signal output from the driving control unit 150.

Figure 3A:
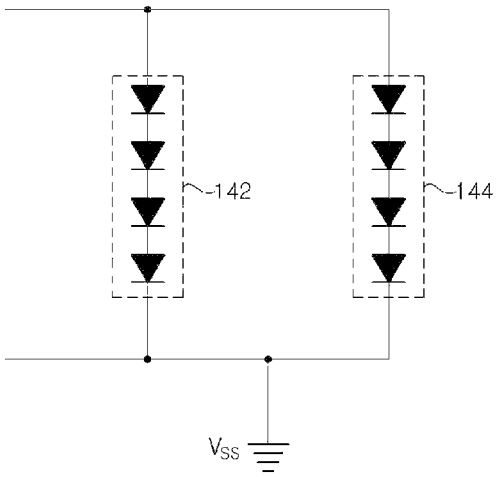
FIG. 3A is a circuit diagram of a first light emitting group and a second light emitting group connected in parallel according to a preferred embodiment of the present invention.

More specifically, in the periods (time periods 0 to $t_2$, and $t_3$ to $t_7$ in FIG. 4) during which the voltage level of the rectified voltage $V_{rec}$ is lower than the second threshold voltage level $V_{TH_2}$, only one light emitting group can emit light. Therefore, the driving control unit 150 controls the first switch SW1, the second switch SW2, and the third switch SW3 such that the first light emitting group 142 and the second light emitting group 144 are connected in parallel. Therefore, in these periods, the driving control unit 150 outputs a first switch control signal SW_CNT1 for turning on the first switch SW1 to the first switch SW1, outputs a second switch control signal SW_CNT2 for turning on the second switch SW2 to the second switch SW2, and outputs a third switch control signal SW_CNT3 for turning off the third switch SW3 to the third switch SW3. A resultant parallel connection relationship between the first light emitting group 142 and the second light emitting group 144 is illustrated in FIG. 3A.

Figure 3B:
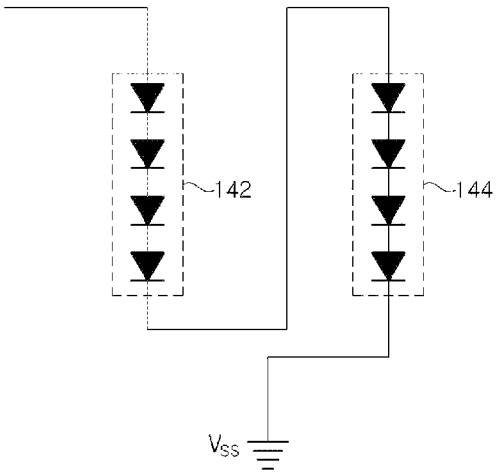
FIG. 3B is a circuit diagram of the first light emitting group and the second light emitting group connected in series according to a preferred embodiment of the present invention.

Meanwhile, when the voltage level of the rectified voltage $V_{rec}$ reaches the second threshold voltage level $V_{TH_2}$ over time ($t_2$ and $t_7$ in FIG. 4), both of the two light emitting groups can emit light. Therefore, the driving control unit 150 controls the first switch SW1, the second switch SW2, and the third switch SW3 such that the first light emitting group 142 and the second light emitting group 144 are connected in series. Therefore, in this period, the driving control unit 150 outputs the first switch control signal SW_CNT1 for turning off the first switch SW1 to the first switch SW1, outputs the second switch control signal SW_CNT2 for turning off the second switch SW2 to the second switch SW2, and outputs the third switch control signal SW_CNT3 for turning on the third switch SW3 to the third switch SW3. A resultant series connection relationship between the first light emitting group 142 and the second light emitting group 144 is illustrated in FIG. 3B.

At a time point when the voltage level of the rectified voltage $V_{rec}$ drops below the second threshold voltage level $V_{TH_2}$ over time ($t_3$ and $t_8$ in FIG. 4), the driving control unit 150 controls the first switch SW1, the second switch SW2, and the third switch SW3 such that the first light emitting group 142 and the second light emitting group 144 are connected in parallel.

The control process described above is performed every period of the rectified voltage (half period of the AC voltage). The light emitting groups included in the LED lighting apparatus 100 according to the present invention always emit light, regardless of the voltage level of the rectified voltage.

Meanwhile, the above-described path selection switch 120, the charging/discharging control switch SW4, the first switch SW1, the second switch SW2, and the third switch SW3 may be implemented using one of a metal-oxide semiconductor field effect transistor (MOSFET), an insulated gate bipolar transistor (IGBT), a bipolar junction transistor (BJT), a junction field effect transistor (JFET), a thyristor (silicon controlled rectifier), and a triac, which can be turned on or off according to the switch control signal input from the driving control unit 150.

As described above, the driving control unit 150 according to the preferred embodiment of the present invention is configured to perform the function of controlling the overall driving of the LED lighting apparatus 100. More specifically, the driving control unit 150 according to the present invention is configured to perform the function of i) connecting the rectification block 110 to the second path $P_2$ in the discharging period and connecting the rectification block 110 to the first path $P_1$ in the charging period, ii) charging the electric charges to the charging/discharging capacitor C1 in the charging period and discharging the charged electric charges so as to cause the LED block to emit light in the discharging period, and iii) controlling the series/parallel connection relationship between the first light emitting group 142 and the second light emitting group 144 according to the voltage level of the rectified voltage $V_{rec}$.

The operating state of each element of the LED lighting apparatus 100 according to the control of the driving control unit 150 based on the voltage level of the rectified voltage $V_{rec}$ during one period is summarized in Table 1 below.

Table 1

TABLE 1

| Threshold Voltage ($V_{TH}$) | Path Selection Switch | Charging/ Discharging Block | SW1 | SW2 | SW3 | Operation |
|---|---|---|---|---|---|---|
| $0 \le V_{rec} < V_{TH1}$ | ($P_2$) | Discharge | ON | ON | OFF | Parallel |
| $V_{TH1} \le V_{rec} < V_{TH2}$ | ($P_1$) | Charge | ON | ON | OFF | Parallel |
| $V_{TH2} \le V_{rec}$ | ($P_1$) | Charge | OFF | OFF | ON | Serial |
| $V_{TH1} \le V_{rec} < V_{TH2}$ | ($P_1$) | Charge | ON | ON | OFF | Parallel |
| $0 \le V_{rec} < V_{TH1}$ | ($P_2$) | Discharge | ON | ON | OFF | Parallel |

Hereinafter, the control process of the driving control unit 150 according to the variation in the voltage level of the rectified voltage $V_{rec}$ with respect to time will be described with reference to Table 1 and FIG. 4. Table 1 shows the operating states during one period of the rectified voltage $V_{rec}$ after the LED lighting apparatus 100 is initially driven and the charging of the charging/discharging block 130 is completed.

First, the driving control unit 150 determines the voltage level of the rectified voltage $V_{rec}$ output from the rectification block 110, controls the path selection switch 120 in the period (time period 0 to $t_1$) during which the voltage level of the rectified voltage $V_{rec}$ is lower than the first threshold voltage $V_{TH_1}$, such that the rectification block 110 is connected to the second path $P_2$, generates the charging/discharging control signal SW_CNT4 to control the charging/discharging control switch SW4 of the charging/discharging block 130 so that electric charges can be charged to the charging/discharging capacitor C1, and connects the first light emitting group 142 and the second light emitting group 144 in parallel by maintaining the first and second switches SW1 and SW2 in the turned-on state and maintaining the third switch SW3 in the turned-off state. In this state, the first light emitting group 142 and the second light emitting group 144 connected in parallel are driven by the electric charges discharged from the charging/discharging block 130.

When the voltage level of the rectified voltage $V_{rec}$ rises with time and reaches the first threshold voltage level $V_{TH_1}$ ($t_1$), the driving control unit 150 determines that the period has reached the charging period, controls the path selection switch 120 such that the rectification block 110 is connected to the charging/discharging block 130 and the LED block 140 through the first path $P_1$, and electric charges are charged to the charging/discharging capacitor by turning on the charging/discharging control switch SW4 of the charging/discharging block 130. In this case, the first light emitting group 142 and the second light emitting group 144 maintain the parallel/series state and emit light by the rectified voltage $V_{rec}$ supplied from the rectification block 110.

In addition, when the voltage level of the rectified voltage $V_{rec}$ rises with time and reaches the second threshold voltage level $V_{TH_2}$ ($t_2$), the driving control unit 150 connects the first light emitting group 142 and the second light emitting group 144 in series by turning off the first switch SW1 and the second switch SW2 and turning on the third switch SW3.

When the voltage level of the rectified voltage $V_{rec}$ drops below the second threshold voltage level $V_{TH_2}$ with time ($t_3$), the driving control unit 150 connects the first light emitting group 142 and the second light emitting group 144 in parallel by turning on the first switch SW1 and the second switch SW2 and turning off the third switch SW3.

In addition, when the voltage level of the rectified voltage $V_{rec}$ drops below the first threshold voltage level $V_{TH_1}$ with time ($t_4$), the driving control unit 150 determines that the period has entered the discharging period, controls the path selection switch 120 such that the rectification block 110 is connected to the ground $V_{ss}$ through the second path $P_2$, and discharges the electric charges from the capacitor by turning off the charging/discharging control switch SW4 of the charging/discharging block 130. In this case, the first light emitting group 142 and the second light emitting group 144 maintain the parallel connection state and are driven by the electric charges discharged from the charging/discharging block 130.

According to the present invention described above, it is possible to expect the effects that can increase the power factor by improving the total harmonic distortion (THD) of the input current in such a manner that the waveform of the input current output from the rectification block is made maximally close to a sine wave by using the path selection switch and the charging/discharging block.

In addition, according to the present invention, it is possible to expect the effects that can improve the luminous intensity uniformity and brightness of the lighting apparatus by causing all LED groups to emit light at above a predetermined voltage level in such a manner that the series/parallel connection relationship among the plurality of light emitting groups are actively controlled according to the voltage level of the rectified voltage.

While the embodiments of the present invention have been described with reference to the specific embodiments, they are provided merely for fully understanding of the present invention, but the present invention is not limited to the embodiments. It will be apparent to those skilled in the art that various changes and modifications may be made without departing from the spirit and scope of the invention as defined in the following claims.

Wherefore, the spirit of the present invention should not be limited to the embodiments, and it will be apparent that the claims and the equivalents or equivalent modifications thereof fall within the scope of the present invention.

What is claimed is:

1. An LED lighting apparatus comprising:

a rectification block configured to rectify an AC voltage to a DC rectified voltage;

an LED block including a first light emitting group and a second light emitting group each including one or more LEDs;

a charging/discharging block configured to charge electric charges in a charging period, and discharge electric charges in a discharging period such that the LED block emits light;

a driving control unit configured to determine a voltage level of the rectified voltage output from the rectification block, controls a path selection switch to connect the rectification block to the LED block and controls the charging/discharging block to charge the charging/discharging block with electric charges, when the voltage level of the rectified voltage enters the charging period, and controls the path selection switch to connect the rectification block to a ground and controls the charging/discharging block to discharge electric charges from the charging/discharging block to the LED block, when the voltage level of the rectified voltage enters the discharging period; and a path selection switch configured to connect the rectification block to the LED block in the charging period, and connect the rectification block to the ground in the discharging period.

2. The LED lighting apparatus of claim 1, wherein the LED block further includes a first switch, a second switch, and a third switch configured to modify a circuit such that the first light emitting group and the second light emitting group are connected in series or in parallel according to the voltage level of the rectified voltage, and the driving control unit controls the first switch, the second switch, and the third switch according to the voltage level of the rectified voltage, such that a connection relationship of the first light emitting group and the second light emitting group is controlled in series or in parallel.

3. The LED lighting apparatus of claim 2, wherein when the input rectified voltage is equal to or higher than a first threshold voltage level and lower than a second threshold voltage level, the driving control unit turns on the first switch and the second switch and turns off the third switch, such that the first light emitting group and the second light emitting group are connected in parallel.

4. The LED lighting apparatus of claim 2, wherein when the input rectified voltage is equal to or higher than the second threshold voltage level, the driving control unit turns off the first switch and the second switch and turns on the third switch, such that the first light emitting group and the second light emitting group are connected in series.

5. The LED lighting apparatus of claim 1, wherein even in a period during which the voltage level of the rectified voltage is lower than the first threshold voltage level, the first light emitting group and the second light emitting group are not turned off and are driven by electric charges discharged from the charging/discharging block.

6. The LED lighting apparatus of claim 1, wherein the charging/discharging block includes a capacitor and a charging/discharging control switch, and the driving control unit controls the charging/discharging control switch, such that electric charges are charged to the capacitor during the charging period, and electric charges charged in the capacitor are supplied to the LED block during the discharging period.

7. The LED lighting apparatus of claim 1, wherein the path selection switch is controlled by a path selection switch control signal (SSW_CNT) output from the driving control unit.

8. The LED lighting apparatus of claim 2, wherein the control of the first switch, the second switch, and the third switch included in the LED block is adjusted by switch control signals (SW_CNT1 to SW_CNT3) output from the driving control unit.

9. The LED lighting apparatus of claim 6, wherein the charging/discharging control switch is controlled by a charging/discharging switch control signal (SW_CNT4) output from the driving control unit.

10. The LED lighting apparatus of claim 1, wherein the path selection switch includes at least one of a metal-oxide semiconductor field effect transistor (MOSFET), an insulated gate bipolar transistor (IGBT), a bipolar junction transistor (BJT), a junction field effect transistor (JFET), a thyristor (silicon controlled rectifier), and a triac.

11. An LED lighting apparatus comprising:

a rectification block configured to rectify an AC voltage to a DC rectified voltage;

an LED block including a first light emitting group and a second light emitting group each including one or more LEDs;

a charging/discharging block configured to charge electric charges in a charging period, and discharge electric charges in a discharging period, such that the LED block emits light; and a driving control unit configured to supply the rectified voltage to the LED block when a voltage level of the rectified voltage enters the charging period, such that electric charges are charged to the charging/discharging block, and connect the rectified voltage to a ground when the voltage level of the rectified voltage enters the discharging period, such that electric charges charged in the charging/discharging block are discharged to the LED block.

12. The LED lighting apparatus of claim 11, wherein the LED lighting apparatus further comprises a path selection switch configured to connect the rectification block to the LED block during the charging period, and connect the rectification block to the ground during the discharging period.

13. The LED lighting apparatus of claim 11, wherein even in a period during which the voltage level of the rectified voltage is lower than the first threshold voltage level, the first light emitting group and the second light emitting group are not turned off and are driven by electric charges discharged from the charging/discharging block.

14. The LED lighting apparatus of claim 11, wherein the charging/discharging block includes a capacitor and a charging/discharging control switch, and the driving control unit controls the charging/discharging control switch, such that electric charges are charged to the capacitor during the charging period, and electric charges charged in the capacitor are supplied to the LED block during the discharging period.

15. The LED lighting apparatus of claim 14, wherein the charging/discharging control switch is controlled by a charging/discharging switch control signal (SW_CNT4) output from the driving control unit.

16. The LED lighting apparatus of claim 2, wherein the path selection switch includes at least one of a metal-oxide semiconductor field effect transistor (MOSFET), an insulated gate bipolar transistor (IGBT), a bipolar junction transistor (BJT), a junction field effect transistor (JFET), a thyristor (silicon controlled rectifier), and a triac.

17. The LED lighting apparatus of claim 3, wherein the path selection switch includes at least one of a metal-oxide semiconductor field effect transistor (MOSFET), an insulated gate bipolar transistor (IGBT), a bipolar junction transistor (BJT), a junction field effect transistor (JFET), a thyristor (silicon controlled rectifier), and a triac.

* * * * *